US008402575B2

(12) United States Patent
Tanaka et al.

(10) Patent No.: US 8,402,575 B2
(45) Date of Patent: Mar. 26, 2013

(54) BETWEEN-BED-AND-WHEELCHAIR MOVE ASSIST APPARATUS

(75) Inventors: Nobuyuki Tanaka, Tokyo (JP); Kenichi Tanaka, Tokyo (JP); Kazuo Mishina, Tokyo (JP)

(73) Assignee: TKC Corporation Ltd., Tokyo (JP)

( * ) Notice: Subject to any disclaimer, the term of this patent is extended or adjusted under 35 U.S.C. 154(b) by 0 days.

(21) Appl. No.: 13/549,805

(22) Filed: Jul. 16, 2012

(65) Prior Publication Data

US 2013/0036548 A1 Feb. 14, 2013

(51) Int. Cl.
*A61G 7/08* (2006.01)

(52) U.S. Cl. ..... 5/81.1 HS; 5/81.1 R

(58) Field of Classification Search ..... 5/81.1 HS, 5/81.1 R, 86.1; 297/115, 217.1
See application file for complete search history.

(56) References Cited

U.S. PATENT DOCUMENTS 2,605,155 A * 7/1952 Lewis ..... 108/139
4,288,124 A * 9/1981 Hamilton ..... 297/233

* cited by examiner

*Primary Examiner* — Fredrick Conley
(74) *Attorney, Agent, or Firm* — Norris McLaughlin & Marcus, P.A.

(57) ABSTRACT

A between-bed-and-wheelchair move assist apparatus arranged to facilitate a caregiver to help a care receiver to move between a bed and a wheelchair, said between-bed-and-wheelchair move assist apparatus comprising a support member mounted in a side rail mount hole of the bed; and a slide board mounted on the support member so as to bridge between a surface of a mat on the bed and the seat surface of a wheelchair by sliding on the mat on the bed and stretching toward the wheelchair from a position on the bed.

1 Claim, 20 Drawing Sheets

(A)

(B)

BETWEEN-BED-AND-WHEELCHAIR MOVE ASSIST APPARATUS

BACKGROUND OF THE INVENTION

1. Field of the Invention

The present invention relates to a between-bed-and-wheelchair move assist apparatus for facilitating a caregiver to help a carereceiver to move between a bed and a wheelchair.

2. Description of the Related Art

It is conceivable that in some case a physically handicapped person with a disability in the lower half of his/her body moves frequently between a bed and a wheelchair to enable his/her free activity. In some cases, such a move is made ten and several times a day.

In many cases, however, physically handicapped persons with disabilities in the lower halves of their bodies also have disabilities in the upper halves of their bodies. In such cases, a need for a caregiver's help ordinarily arises at the time of moving between a bed and a wheelchair. The burden on a caregiver at the time of moving between a bed and a wheelchair in such cases is considerably large. This is a major cause of the occurrence of lumbago in caregivers and is a factor responsible for not settling caregivers in care facilities.

As an instrument for enabling a physically handicapped person to move with safety between a wheelchair and a bed, an "instrument for move from a wheelchair onto a bed" described in Japanese Patent Laid-Open No. 2006-175069 is known.

The "instrument for move from a wheelchair onto a bed" described in Japanese Patent Laid-Open No. 2006-175069 has a spanning member 1 in the form of a rectangular board laid between the upper surfaces of the seat of a wheelchair and a bed. Recesses 11 in which frame portions d positioned at the front of the wheelchair can be inserted are formed in the spanning member 1 at the longer side edge of the same. Support members 2 are provided below the lower surface of the spanning member 1 to support the spanning member 1. In this way, a direct connection along a plane is made between the wheelchair and the bed by means of the spanning member 1. Also, the frame portions d of the wheelchair are inserted in the spanning member 1. As a result, the spacing between the seat of the wheelchair and the bed is reduced and the distance through which the body is moved is correspondingly reduced, thus enabling a person with a disability in the lower half of his/her body to move easily.

However, the "instrument for move from a wheelchair onto a bed" described in Japanese Patent Laid-Open No. 2006-175069 is large in size and is, therefore, obstructive when placed by the side of a bed. Moreover, a physically handicapped person with a disability in the upper half of his/her body needs help from a caregiver at the time of moving from a wheelchair onto a bed. In this case, the legs of the physically handicapped person and the instrument interfere with each other. Thus, the usability of the instrument is low.

It is, therefore, an object of the present invention to provide a between-bed-and-wheelchair move assist apparatus simple in construction, capable of facilitating a caregiver to help a carereceiver when the carereceiver moves between a bed and a wheelchair, and improved in usability.

SUMMARY OF THE INVENTION

To achieve the above-described object, according to a first aspect of the present invention, there is provided a between-bed-and-wheelchair move assist apparatus arranged to facilitate a caregiver to help a carereceiver to move between a bed and a wheelchair, the between-bed-and-wheelchair move assist apparatus including a support member mounted in a side rail mount hole of the bed, and a slide board mounted on the support member so as to bridge between a surface of a mat on the bed and a seat surface of the wheelchair by sliding on the mat on the bed and stretching toward the wheelchair from a position on the bed.

According to a second aspect of the present invention, in the apparatus according to the first aspect, the support member is constituted by a U-shaped member formed of two support portions having a base end portion in which the two support portions are connected to each other, and is mounted so as to be turnable relative to the bad by inserting in the side rail mount hole of the bed a shaft embedded in the base end portion of the support member, and the slide board is mounted so as to be turnable relative to the support member about one of the two support portions of the support member used as a shaft for turning.

According to a third aspect of the present invention, there is provided a between-bed-and-wheelchair move assist apparatus arranged to facilitate a caregiver to help a carereceiver to move between a bed and a wheelchair, the between-bed-and-wheelchair move assist apparatus including a U-shaped support member formed of two support portions disposed parallel to each other and a common support portion to which one end of each of the two support portions is connected, a first mount shaft embedded in a first axial support portion axially supporting the common support portion, the first mount shaft having its tip end inserted in the side rail mount hole of the bed, a second mount shaft connected to the first mount shaft through an arm portion, the second mount shaft having its tip end inserted in another side rail mount hole of the bed, a slide board mounted so as to be turnable about one of the two support portions used as a shaft for turning, and lock means provided on the first mount shaft, the lock means locking the slide board from turning when a predetermined angle of turning of the slide board is reached.

According to a fourth aspect of the present invention, in the apparatus according to the third aspect, the lock means has a cut portion provided in a second axial support portion axially supporting the first mount shaft at one end of the arm portion, the cut portion being formed at a position corresponding to the predetermined angle of the first mount shaft, and a lock plate attached to the first mount shaft, the lock plate being fitted in the cut portion when the predetermined angle of turning of the first mount shaft is reached.

According to a fifth aspect of the present invention, in the apparatus according to the first aspect, the support member has a first support portion mounted on the bed by inserting in the side rail mount holes of the bed a first shaft and a second shaft embedded at opposite ends, and a second support portion turnably attached to the second shaft, and the slide board is mounted on the second support portion.

According to a sixth aspect of the present invention, in the apparatus according to the first aspect, the support member has a support portion mounted on the bed by inserting in the side rail mount holes of the bed a first shaft and a second shaft embedded at opposite ends, and a third shaft and a fourth shaft capable of moving along a longitudinal direction of the support portion, and the slide board is mounted on the support portion by means of the third shaft used as a shaft for turning and has a guide slit guiding the fourth shaft.

According to a seventh aspect of the present invention, in the apparatus according to the first aspect, the support member has two embedded portions mounted on the bed by inserting one end of each embedded portion in the side rail mount hole of the bed, and two support portions attached to the two embedded portions so as to be turnable in a plane perpendicular to the bed, and the slide board is mounted on the two support portions so as to be slidable in a direction perpendicular to the bed.

The present invention enables providing a between-bed-and-wheelchair move assist apparatus simple in construction, capable of facilitating a caregiver to help a carereceiver when the carereceiver moves between a bed and a wheelchair, improved in usability and not obstructive when not used.

DETAILED DESCRIPTION OF THE PREFERRED EMBODIMENTS (First Embodiment)

Hereinafter, embodiments of between-bed-and-wheelchair move assist apparatus according to the present invention will be explained with accompanying the drawings.

Figure 1:
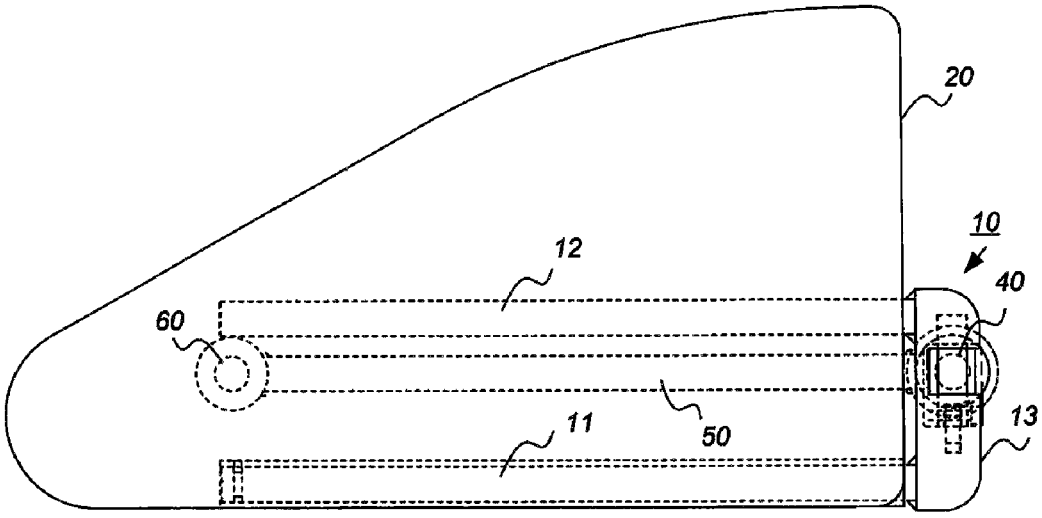
FIG. 1 is a plan view of a between-bed-and-wheelchair move assist apparatus according to a first embodiment of the present invention.
Figure 2:
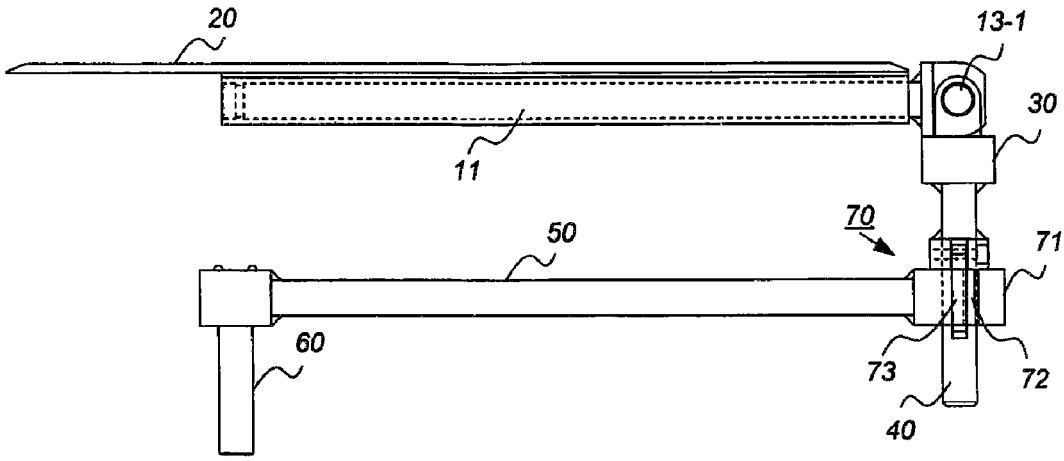
FIG. 2 is a front view of the between-bed-and-wheelchair move assist apparatus shown in FIG. 1.
Figure 3:
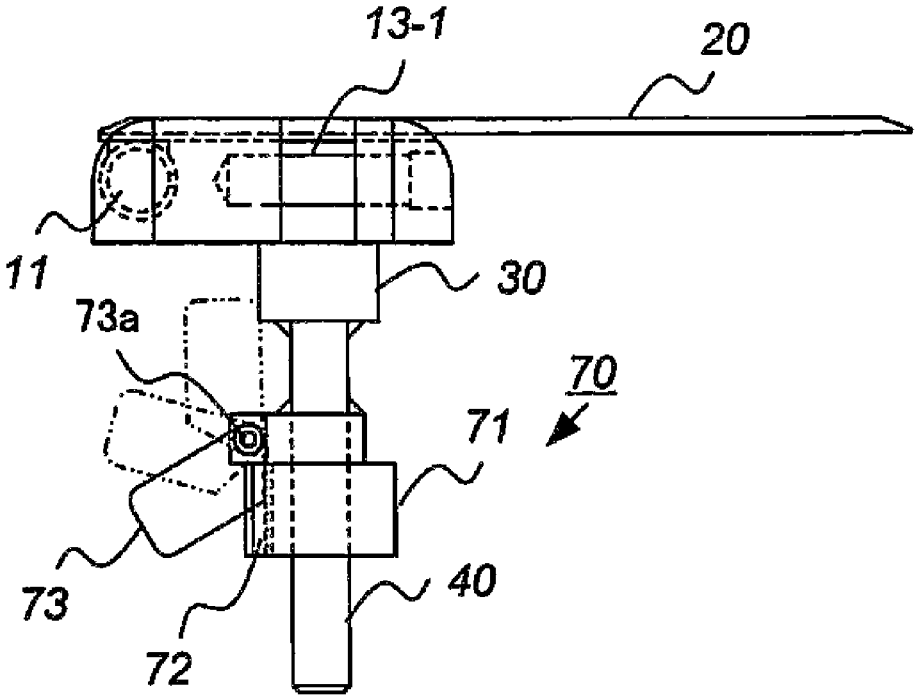
FIG. 3 is a side view of the between-bed-and-wheelchair move assist apparatus shown in FIG. 1.

FIG. 1 is a plan view of a between-bed-and-wheelchair move assist apparatus according to a first embodiment of the present invention. FIGS. 2 and 3 are a front view and a side view, respectively, of the apparatus.

Referring to FIGS. 1 to 3, the between-bed-and-wheelchair move assist apparatus has a U-shaped support member 10 formed of two support portions 11 and 12 disposed parallel to each other and a common support portion 13 to which one end of each of the support portions 11 and 12 is connected; a first mount shaft 40 embedded in a first axial support portion 30 axially supporting a shaft 13-1 in the common support portion 13, the first mount shaft 40 having its tip inserted in a side rail mount hole in a bed (not shown); a second mount shaft 60 connected to the first mount shaft 40 by an arm portion 50 and having its tip inserted in another side rail mount hole in the bed; a slide board 20 mounted so as to be turnable about one of the two support portions 11 and 12 used as a shaft for turning; and a lock means 70 provided on the first mount shaft 40, the lock means 70 locking the slide board 20 from turning when a predetermined angle of turning of the slide board 20 is reached.

The lock means 70 is provided on an axial support portion 71 that axially supports the first mount shaft 40 at one end of the arm portion 50. The lock means 70 is constituted by a cut portion 72 formed in the first mount shaft 40 at a position corresponding to an angle of 15 degrees for example, and a lock plate 73 turnably attached to the first mount shaft 40 by means of a shaft 73*a* and capable of being fitted in the cut portion 72 when the angle of turning of the first mount shaft 40 reaches 15 degrees.

That is, the axial support portion 71 is formed of a cylindrical member, and the cut portion 72 having a predetermined width is formed in the axial support portion 71 along the axis of the same at a position corresponding to the position to which the first mount shaft 40 turns through 15 degrees. On the other hand, the lock plate 73 turnably attached to the first mount shaft 40 by means of the shaft 73*a* is attached to the first mount shaft 40.

The lock plate 73 is maintained in contact with a peripheral portion of the axial support portion 71 by its weight or the resilience of a resilient member (not shown) before the angle of turning of the first mount shaft 40 reaches 15 degrees. In this state, the lock plate 73 does not impede the turning of the first mount shaft 40. When the angle of turning of the first mount shaft 40 reaches 15 degrees, the lock plate 73 is fitted in the cut portion 72 by its weight or the resilience of the resilient member (not shown) to lock the first mount shaft 40 from turning.

Unlocking of the lock means 70 can be performed by turning the lock plate 73 in the direction of return to the home position against the weight of the lock plate 73 or the resilience of the resilient member (not shown).

The lock mechanism using the cut portion 72 and the lock plate 73 as the lock means 70 has been described with respect to the present embodiment. However, these components are not exclusively used. The lock means 70 may be constituted by any other components if it is capable of locking the slide board 20 from turning when the predetermined angle of turning of the first mount shaft 40 is reached.

Figure 4:
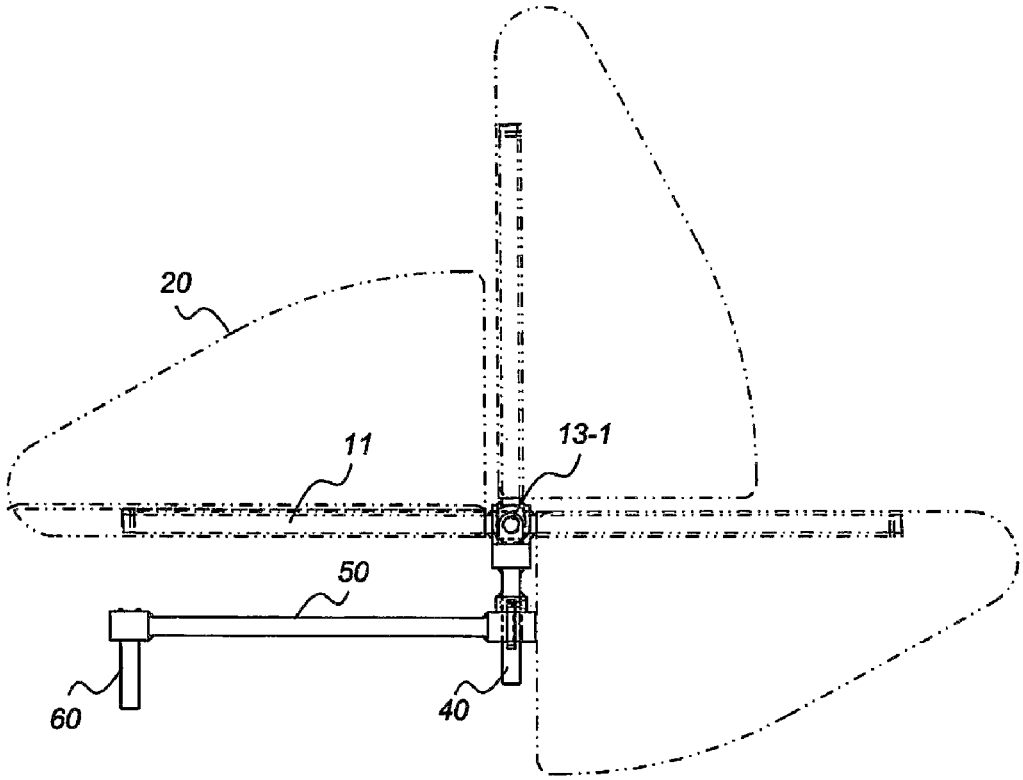
FIG. 4 is a diagram for explaining retraction of the between-bed-and-wheelchair move assist apparatus shown in FIGS. 1 to 3 when the apparatus is not used.
Figure 5:
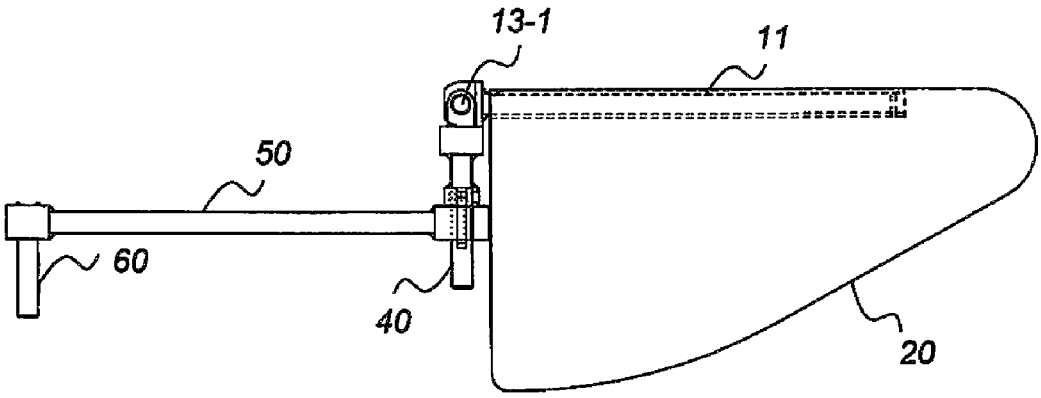
FIG. 5 is a diagram showing a retracted state of the between-bed-and-wheelchair move assist apparatus shown in FIGS. 1 to 3.

FIG. 4 is a diagram showing retraction of the between-bed-and-wheelchair move assist apparatus shown in FIGS. 1 to 3 when the apparatus is not used. FIG. 5 is a diagram showing a retracted state of the apparatus when the apparatus is not used.

In the between-bed-and-wheelchair move assist apparatus shown in FIGS. 1 to 3, the U-shaped support member 10 formed of the two support portions 11 and 12 and the common support portion 13 is constructed so as to be turnable about the shaft 13-1 in the common support portion 13.

In this arrangement, the support member 10 and the slide board 20 can be moved rightward from an ordinary use position of the between-bed-and-wheelchair move assist apparatus by turning the support member 10 clockwise about the shaft 13-1 together with the slide board 20 when the apparatus is not used. In this way, avoidance of hindrance to caregiving after a move of a carereceiver is enabled.

That is, when the between-bed-and-wheelchair move assist apparatus is not used, the support member 10 is turned about the first mount shaft 40 used as a shaft for turning so that the support portion 11 supporting the slide board 20 is parallel to a frame of a bed (not shown). In this state, the slide board 20 is vertically raised by being turned about the shaft for turning, i.e., the first mount shaft 40, as shown in FIG. 4. Then, the support member 10 and the slide board 20 are turned clockwise on the shaft for turning, i.e., the shaft 13-1. In this way, the support member 10 and the slide board 20 can be moved and retracted to a position shown in FIG. 5, i.e., a position on the right-hand side relative to the ordinary use position of the between-bed-and-wheelchair move assist apparatus, such that no considerable hindrance to caregiving occurs.

An example of use of the between-bed-and-wheelchair move assist apparatus according to the present invention when a carereceiver moves between a bed and a wheelchair will be described with reference to FIGS. 6 and 7.

The between-bed-and-wheelchair move assist apparatus shown in FIGS. 1 to 5 is mounted by inserting the tips of the first mount shaft 40 and the second mount shaft 60 in two side rail mount holes 130-1 and 130-2 in side rail mount holes 130 provided in a bed frame 120 of a care bed 100. Use of the between-bed-and-wheelchair move assist apparatus is enabled thereby.

As an example of use of the between-bed-and-wheelchair move assist apparatus, there are two modes:

1) one in the case of facilitating a caregiver to help a carereceiver to move from a bed to a wheelchair; and
2) one in the case of facilitating a caregiver to help a carereceiver to move from a wheelchair to a bed.

Figure 6:
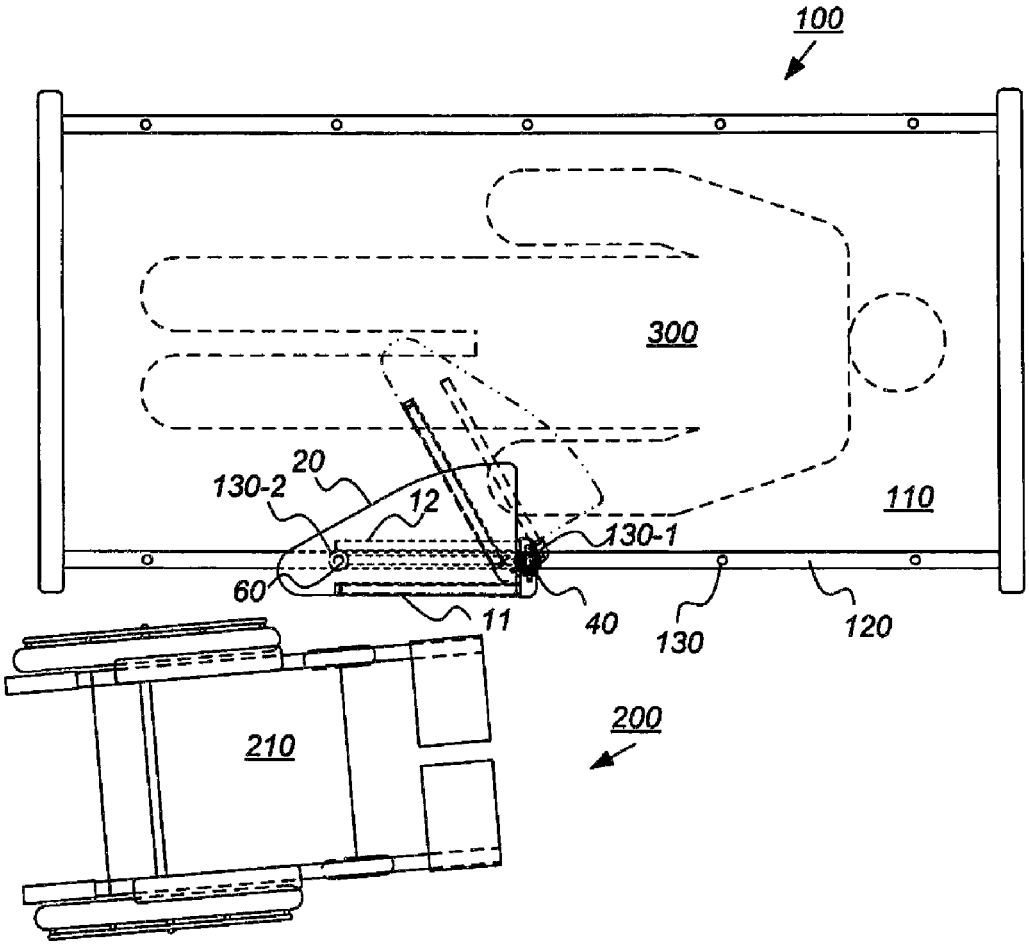
FIG. 6 is a diagram for explaining an example of use of the between-bed-and-wheelchair move assist apparatus according to the present invention when a carereceiver moves between a bed and a wheelchair.

In the case of facilitating a caregiver to help a carereceiver to move from a bed to a wheelchair, the slide board 20 is first set so that it is placed above a mat 110 on a bed 100, as indicated by a solid line in FIG. 6.

The hip of a carereceiver 300 is then placed on the slide board 20 by turning the support member 10 about the first mount shaft 40 used as a shaft for turning toward a position on the carereceiver 300 side, i.e., the bed 100 center side. In this state, the slide board 20 is drawn to the edge of the bed 100 by turning the support member 10 about the first mount shaft 40 used as a shaft for turning.

Next, check is made as to the position of a wheelchair 200 to which the carereceiver 300 at the side of the bed 100 is to move and whether or not a stopper is on. Thereafter, the support member 10 is further turned about the first mount shaft 40 used as a shaft for turning so that the slide board 20 is stretched on the wheelchair 200 side beyond the edge of the bed 100.

When the angle of turning of the mount shaft 40 reaches 15 degrees, the lock means 70 locks the slide board 20 from turning. The slide board 20 is thereby stopped in this state.

In this state, the wheelchair 200 is set so that the slide board 20 reaches a seat surface 210 of the wheelchair 200 by its tip.

Thereafter, the carereceiver 300 is slid on the slide board 20 to be moved from the position on the slide board 20 to a position on the seat surface 210 of the wheelchair 200. During this movement, the lock means 70 locks the slide board 20 from turning and, therefore, the slide board 20 does not escape to any position on the bed 100 side.

Next, the wheelchair 200 is moved backward and the slide board 20 is removed from the seat surface 210 of the wheelchair 200. Unlocking of the lock means 70 is performed and the slide board 20 is returned to the original position, thereby completing the process of facilitating the caregiver to help the carereceiver to move from the bed to the wheelchair.

Figure 7:
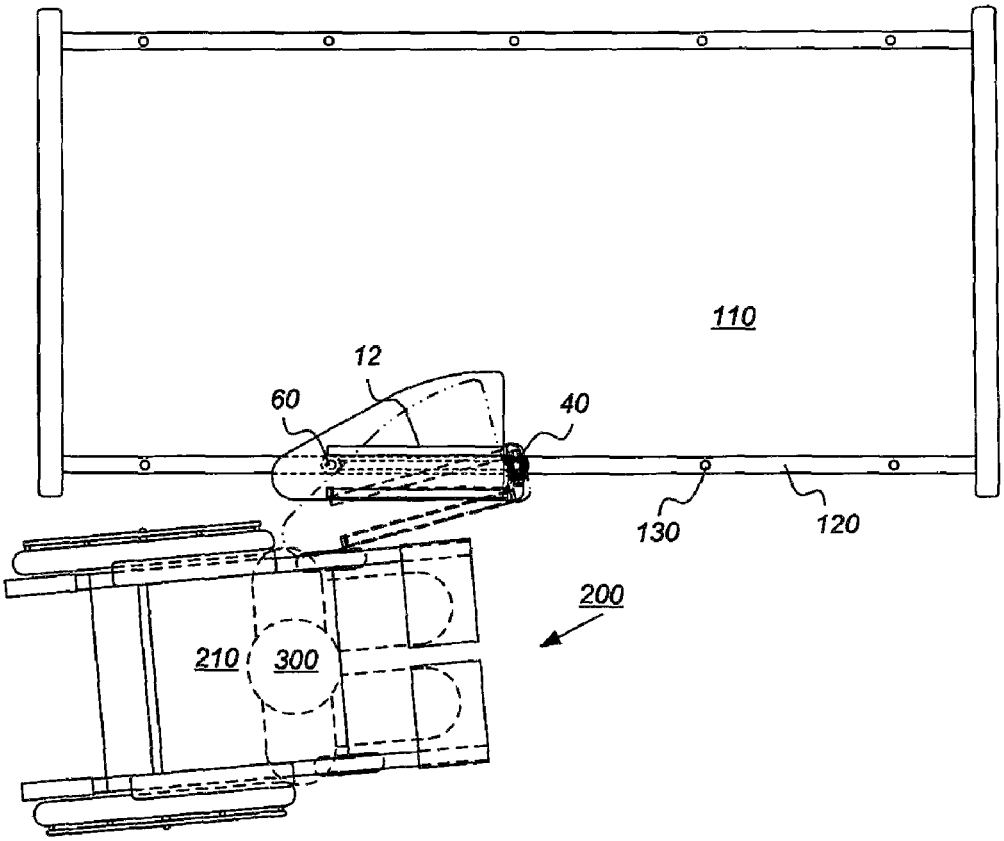
FIG. 7 is a diagram for explaining an example of use of the between-bed-and-wheelchair move assist apparatus according to the present invention when a carereceiver moves between a bed and a wheelchair.

In the case of facilitating the caregiver to help the carereceiver to move from the wheelchair to the bed, the support member 10 is turned about the first mount shaft 40 used as a shaft for turning from the position corresponding to the position of the slide board 20 above the mat 110 on the bed 100 as indicated by a solid line in FIG. 7, thereby stretching the slide board 20 on the wheelchair 200 side beyond the edge of the bed 100. The lock means 70 locks the slide board 20 from turning when the angle of turning of the mount shaft 40 reaches 15 degrees. The slide board 20 is stopped in this state.

The wheelchair 200 on which the carereceiver 300 is sitting is moved so that the slide board 20 reaches the seat surface 210 of the wheelchair 200 by its tip, and the stopper of the wheelchair 200 is put on.

Next, the carereceiver 300 from the wheelchair 200 is slid on the slide board 20 to be moved onto the mat 110 on the bed 100. Since at this time the lock means 70 locks the slide board 20 from turning, the slide board 20 does not escape to any position on the bed 100 side. Therefore the carereceiver 300 can be slid on the slide board 20 with safety.

Thereafter, unlocking of the lock means 70 is performed and the slide board 20 is returned to the original position, thereby completing the process of facilitating the caregiver to help the carereceiver 300 to move from the wheelchair to the bed.

Retraction of the between-bed-and-wheelchair move assist apparatus when the apparatus is not used will next be described with reference to FIGS. 8 and 9.

In the between-bed-and-wheelchair move assist apparatus shown in FIGS. 1 to 5, when the apparatus is not used, the slide board 20 is turned to a position on the side rail 140 side of the bed 100 along a direction toward the head of the carereceiver 300 to clear a central portion of the bed 100 used by the between-bed-and-wheelchair move assist apparatus, thus securing a space at the time of caregiving.

That is, the between-bed-and-wheelchair move assist apparatus, mounted by inserting the tip of the first mount shaft 40 and the second mount shaft 60 in the two side rail mount holes 130-1 and 130-2 in the central portion of the bed 100 to facilitate a caregiver to help a carereceiver to move between a bed and a wheelchair, may be a hindrance to use of the central portion of the bed 100 when the between-bed-and-wheelchair move assist apparatus is not used.

Figure 8:
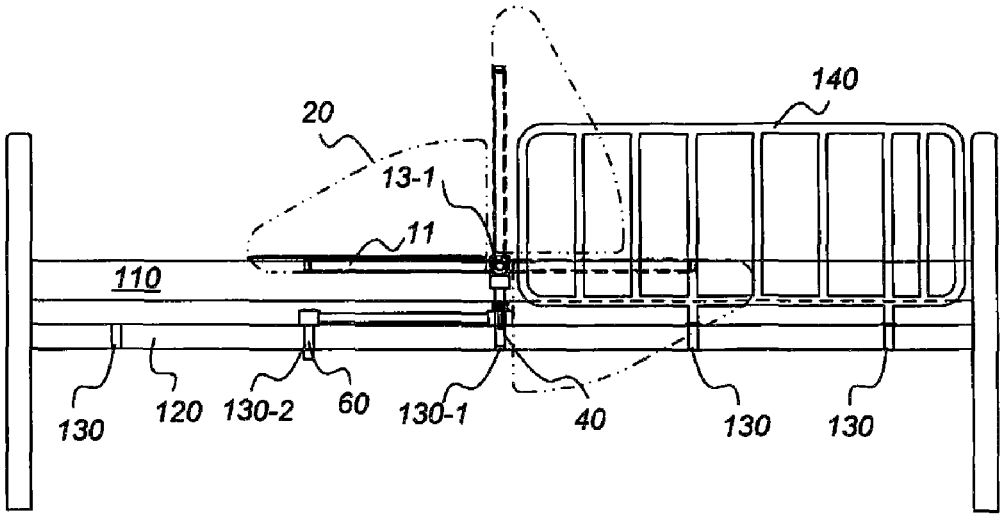
FIG. 8 is a diagram for explaining retraction of the between-bed-and-wheelchair move assist apparatus according to the present invention when the apparatus is not used.
Figure 9:
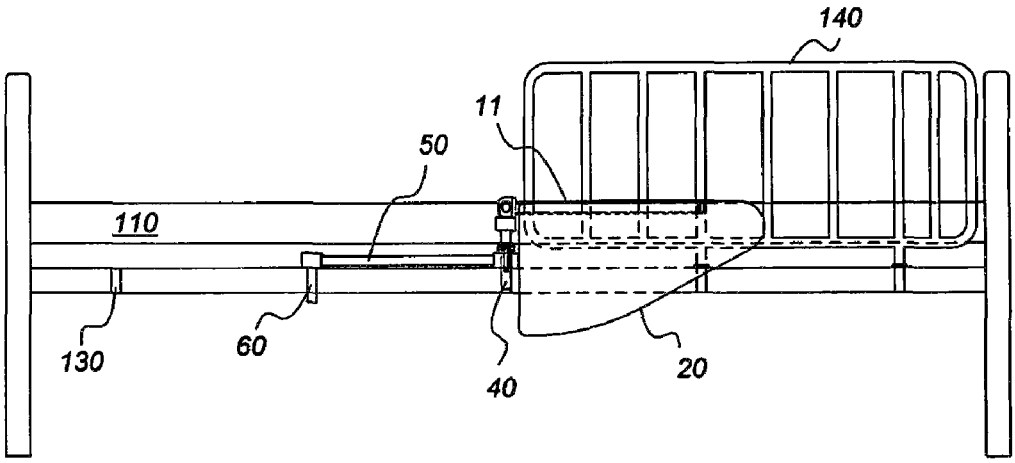
FIG. 9 is a diagram showing a retracted state of the between-bed-and-wheelchair move assist apparatus according to the present invention when the apparatus is not used.

In the between-bed-and-wheelchair move assist apparatus, therefore, as shown in FIG. 8, the support member 10 is turned about the first mount shaft 40 used as a shaft for turning so that the support portion 11 supporting the slide board 20 is parallel to the frame 120 of the bed and, in this state, the slide board 20 is raised perpendicularly to the mat 110 on the bed by being turned about the first mount shaft 40 used as a shaft for turning and, in this state, the support member 10 and the slide board 20 are turned about the shaft for turning, i.e., the shaft 13-1, to a position on the side rail 140 side along a direction toward the head of the carereceiver 300, thereby retracting the slide board 20 in a state shown in FIG. 9.

Figure 10:
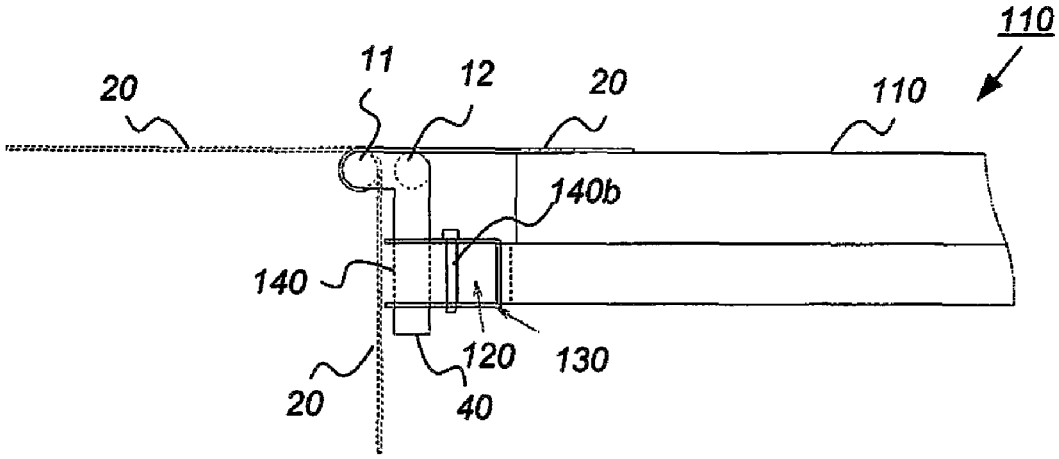
FIG. 10 is a diagram showing another example of the mounted state of the between-bed-and-wheelchair move assist apparatus shown in FIG. 1.

This arrangement enables securing a space at the time of caregiving, when the between-bed-and-wheelchair move assist apparatus is not used, by clearing the central portion of the bed 100 used by the between-bed-and-wheelchair move assist apparatus. Also, since the slide board 20 of the between-bed-and-wheelchair move assist apparatus is retracted on the lower side of the side rail 140 along the direction toward the head of the carereceiver 300, it is not obstructive. In the above-described embodiment, the between-bed-and-wheelchair move assist apparatus is mounted on the bed 100 by inserting the first mount shaft 40 and the second mount shaft 60 in the side rail mount holes 130 provided in the frame 120. However, the arrangement may alternatively be such that, as shown in FIG. 10, the between-bed-and-wheelchair move assist apparatus is mounted on the bed 100 by means of a fitting 140 on the frame 120 of the bed 100, the fitting 140 having a mount hole 140*a* formed therein. A member 140*b* is a pin for attaching the fitting 140 to the frame 120 of the bed 100.

In the above-described embodiment, a U-shaped member formed of two support portions 11 and 12 and a common support portion 13 to which one end of each of the two support portions 11 and 12 is connected is used as the support member 10. However, if the slide board 20 is formed into such a shape that it can be supported by the support portion 11 and the common support portion 13, an L-shaped support member having only the support portion 12 in the two support portions 11 and 12 may alternatively be used.

(Second Embodiment)

Figure 11:
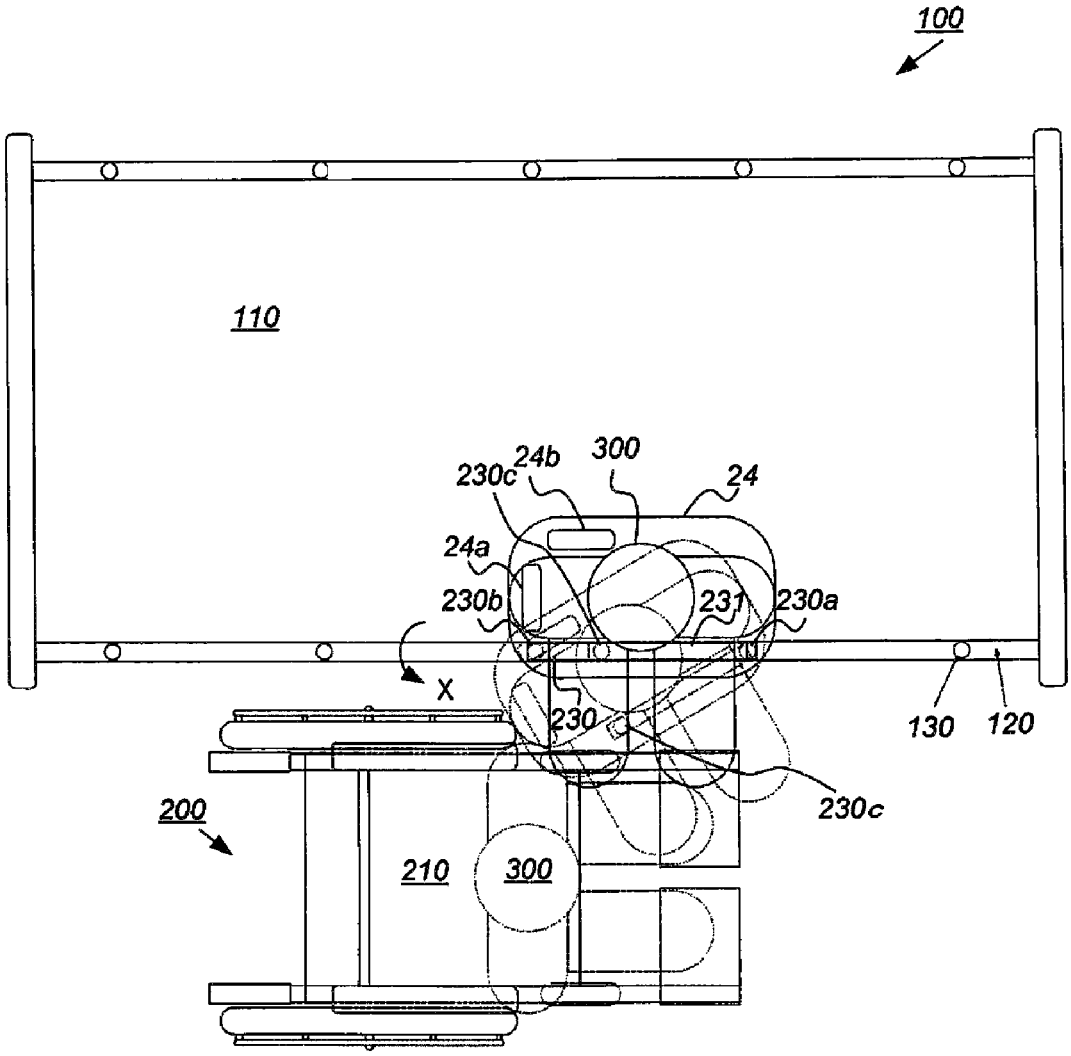
FIG. 11 is a diagram showing a between-bed-and-wheelchair move assist apparatus according to a second embodiment of the present invention.

FIG. 11 is a diagram showing a between-bed-and-wheelchair move assist apparatus according to a second embodiment of the present invention.

The between-bed-and-wheelchair move assist apparatus in the second embodiment shown in FIG. 11 is mounted on the bed 100 by using the side rail mount holes 130 provided in the frame 120 of the bed 100, as is that in the first embodiment.

The between-bed-and-wheelchair move assist apparatus has a first support portion 230 having a first shaft 230*a* and a second shaft 230*b* embedded at opposite ends, a second support portion 231 turnably attached to the second shaft 230*b* in the first support portion 230, and a slide board 24 attached to the second support portion 231.

The first support portion 230 is mounted on the bed 100 by inserting the first shaft 230*a* and the second shaft 230*b* in the side rail mount holes 130 of the bed 100.

The second support portion 231 has its one end turnably attached to the first shaft 230*a* in the first support portion 230 and has at the other end an engaging projection 231*a* engaged with a hole 230*c* provided in the first support portion 230.

When the carereceiver 300 is moved from the bed 100 onto the wheelchair 200, the caregiver first adjusts the height of the surface of the mat 110 on the bed 100 to a height generally equal to or slightly higher than the height of the seat surface 210 of the wheelchair 200 by using a well-known height adjustor (not shown) provided on the bed, and sets the slide board 24 in a state indicated by a solid line in FIG. 11, with the engaging projection 231*a* on the second support portion 231 engaged with the hole 230*c* in the first support portion 230. The caregiver then moves the wheelchair 200 to a position indicated in FIG. 11 and locks the wheelchair 200 at this position from moving.

In this state, the first support portion 230 and the second support portion 231 are in such positions as to be parallel to the frame 120 of the bed 100, and the greater part of the lower surface of the slide board 24 is located above the mat 110 on the bed 100.

The carereceiver 300 on the bed 100 is then led to sit on the slide board 24 at the edge of the bed 100. This operation to lead the carereceiver 300 to sit on the slide board 24 is generally the same as the ordinary operation in which the carereceiver 300 sits on the edge of the bed 100. Therefore the process in this case can be performed without any considerable burden on the caregiver.

Figure 12:
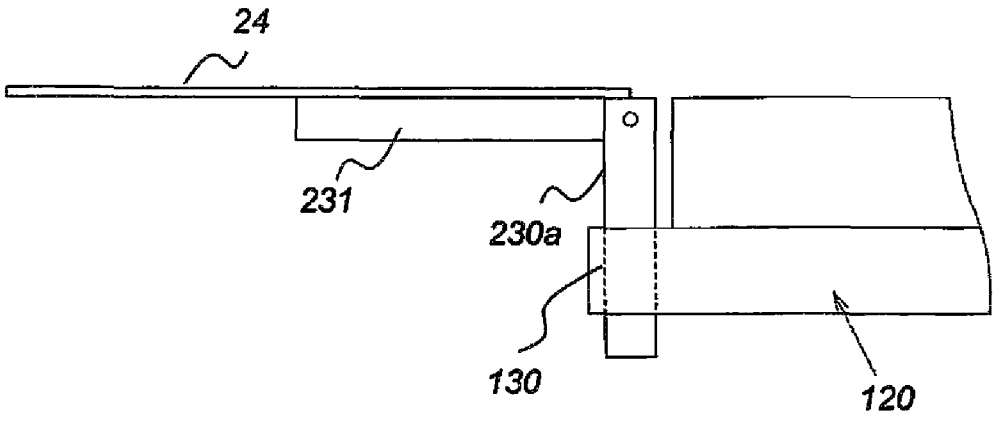
FIG. 12 is a side view showing a state in which the slide board of the between-bed-and-wheelchair move assist apparatus shown in FIG. 11 is horizontally stretched out from a position on a mad on a bed.

Next, the caregiver turns the slide board 24 on the first shaft 230*a* as a shaft for turning in the direction of arrow X together with the carereceiver 300 by putting his/her hand in a handle hole 24*a* or a handle hole 24*b* in the slide board 24 to stretch the other end of the slide board 24 horizontally from the position above the mat 110 on the bed 100 so that the tip end of the slide board 24 is put on the seat surface 210 of the wheelchair 200. In this state, the upper surface of the mat 110 on the bed 100 and the seat surface 210 of the wheelchair 200 are bridged with the slide board 24. FIG. 12 is a side view showing a state where the other end of the slide board 24 is stretched horizontally from the position above the mat 110 on the bed. The lower surface of the slide board 24 is supported by the second support portion 231.

Next, the caregiver leads the carereceiver 300 onto the seat surface 210 of the wheelchair 200 by using the slide board 24 and sliding the carereceiver 300 on the slide board 24, thereby completing the caregiving process in which the carereceiver 300 is moved from the position on the bed 100 onto the seat surface 210 of the wheelchair 200.

In the above-described sequence of operations, the legs of the carereceiver 300 do not interfere with the between-bed-and-wheelchair move assist apparatus and there is no need for the caregiver's operation to directly lift the carereceiver 300. Thus, the burden on the caregiver when the carereceiver 300 is moved from the bed 100 to the wheelchair 200 can be largely reduced.

For caregiving when the carereceiver 300 is moved from the wheelchair 200 to the bed 100, the sequence of operations reverse to that described above may be performed. Also in this case, there is no need for the caregiver's operation to directly lift the carereceiver 300. Thus, the burden on the caregiver when the carereceiver 300 is moved from the wheelchair 200 to the bed 100 can be largely reduced. In this case, the height of the surface of the mat 110 on the bed 100 is adjusted to a height generally equal to or slightly lower than the height of the seat surface 210 of the wheelchair 200.

Figure 13:
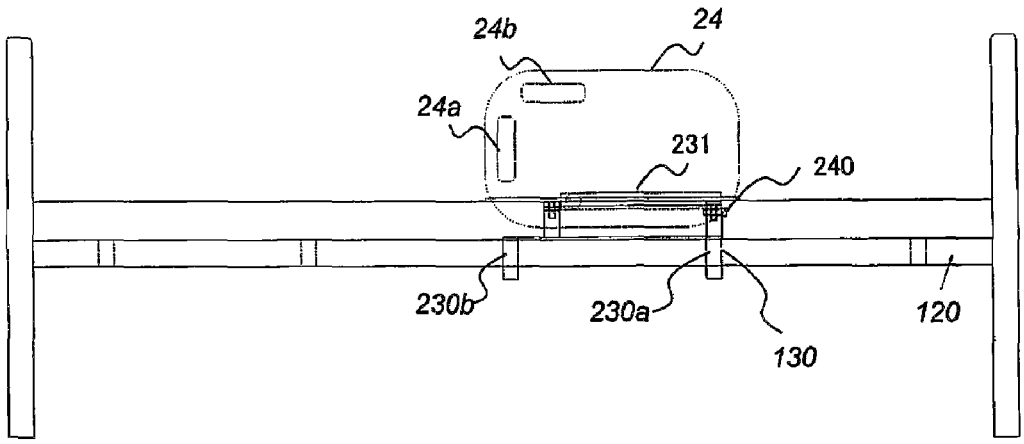
FIG. 13 is a diagram showing a mounted state of the between-bed-and-wheelchair move assist apparatus shown in FIG. 11 when the apparatus is not used.
Figure 13:
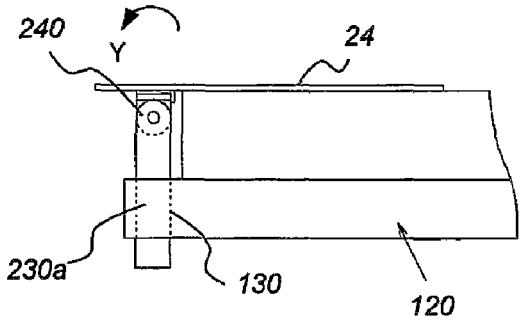

FIG. 13(A) is a diagram showing a mounted state of the between-bed-and-wheelchair move assist apparatus shown in FIG. 11 when the apparatus is not used.

When the between-bed-and-wheelchair move assist apparatus is not used, it functions as a bed guard, as shown in FIG. 13(A). That is, in the between-bed-and-wheelchair move assist apparatus in the present embodiment, the first support portion 230 and the second support portion 231 are connected to each other by a hinge (not shown). When the between-bed-and-wheelchair move assist apparatus is not used, the slide board 24 is raised from the frame 120 of the bed 100 to an arrow direction by using the hinge, as shown in FIG. 13(B) to function as a bed guard.

(Third Embodiment)

Figure 14:
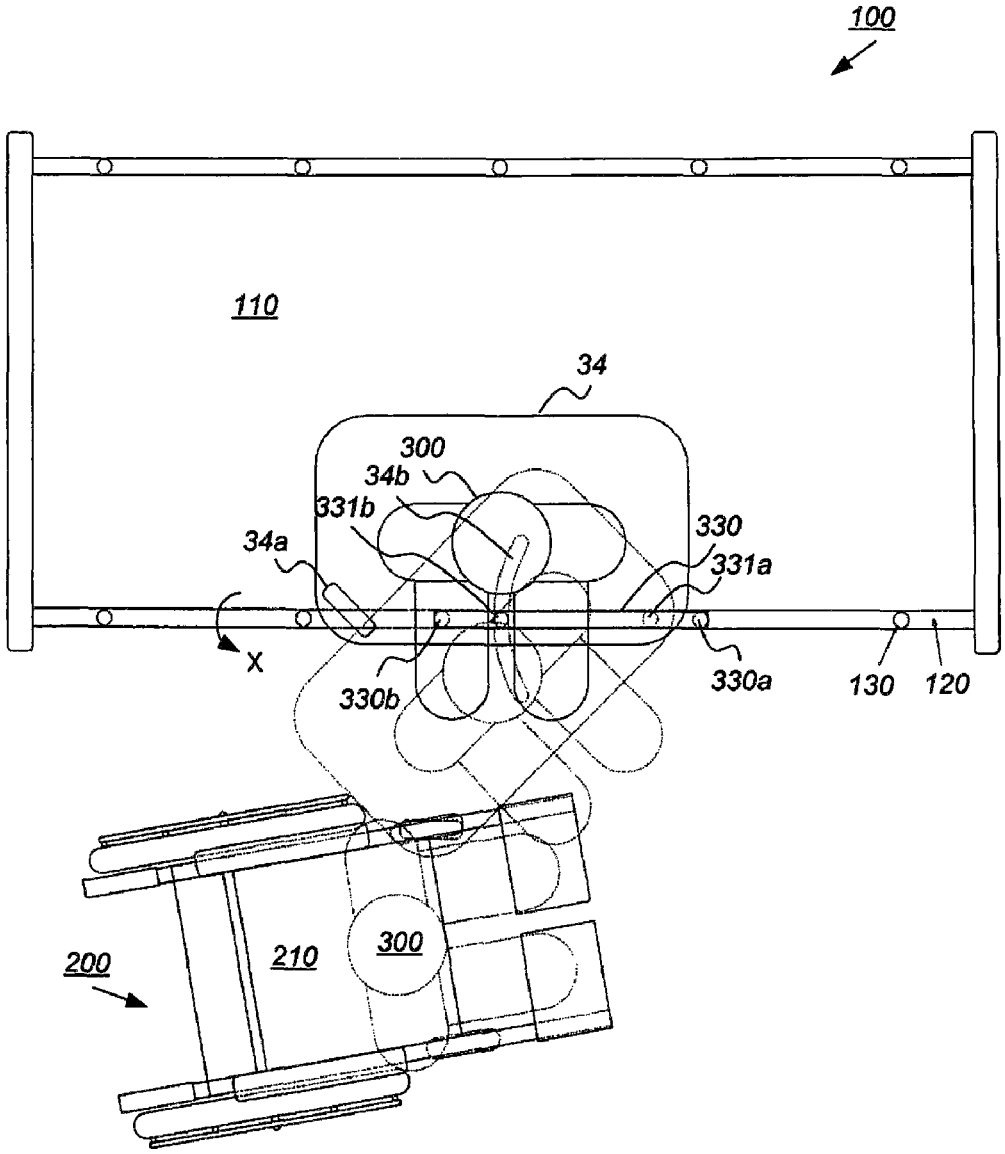
FIG. 14 is a diagram showing a between-bed-and-wheelchair move assist apparatus according to a third embodiment of the present invention.

FIG. 14 is a diagram showing a between-bed-and-wheelchair move assist apparatus according to a third embodiment of the present invention.

The between-bed-and-wheelchair move assist apparatus in the embodiment shown in FIG. 14 is mounted on the bed 100 by using the side rail mount holes 130 provided in the frame 120 of the bed 100, as is that in the first or second embodiment.

The between-bed-and-wheelchair move assist apparatus has a support portion 330 having a first shaft 330*a* and a second shaft 330*b* embedded at opposite ends, a third shaft 331*a* and a fourth shaft 331*b* movable along the longitudinal direction of the support portion 330, a slide board 34 turnably attached to the third shaft 331*a* and having a guide slit 34*b* that guides the fourth shaft 331*b*.

The support portion 330 is mounted on the bed 100 by inserting the first shaft 330*a* and the second shaft 330*b* in the side rail mount holes 130 of the bed 100.

When the carereceiver 300 is moved from the bed 100 onto the wheelchair 200, the caregiver first adjusts the height of the surface of the mat 110 on the bed 100 to a height generally equal to or slightly higher than the height of the seat surface 210 of the wheelchair 200 by using a well-known height adjustor (not shown) provided on the bed, and sets the slide board 34 in a state indicated by a solid line in FIG. 14. The caregiver then moves the wheelchair 200 to a position indicated in FIG. 14 and locks the wheelchair 200 at this position from moving.

In this state, the greater part of the lower surface of the slide board 34 is located above the mat 110 on the bed 100. The carereceiver 300 on the bed 100 is then led to sit on the slide board 34 at the edge of the bed 100. This operation to lead the carereceiver 300 to sit on the slide board 34 is generally the same as the ordinary operation in which the carereceiver 300 sits on the edge of the bed 100. Therefore the process in this case can be performed without any considerable burden on the caregiver.

Figure 15:
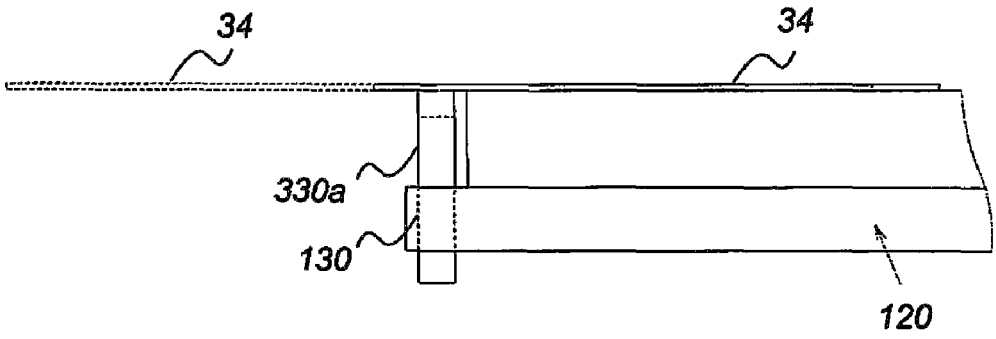
FIG. 15 is a diagram showing a mounted state of the between-bed-and-wheelchair move assist apparatus shown in FIG. 14 when the apparatus is used.

Next, the caregiver turns the slide board 34 on the third shaft 331*a* as a shaft for turning in the direction of arrow X together with the carereceiver 300 by putting his/her hand in a handle hole 34*a* in the slide board 34, with the guide slit 34*b* used as a slit for guiding the fourth shaft 331*b*, thereby stretching the other end of the slide board 34 horizontally from the position above the mat 110 on the bed 100 so that the tip end of the slide board 34 is put on the seat surface 210 of the wheelchair 200. In this state, the upper surface of the mat 110 on the bed 100 and the seat surface 210 of the wheelchair 200 are bridged with the slide board 34. FIG. 15 is a side view showing a state where the other end of the slide board 34 is stretched horizontally from the position above the mat 110 on the bed 100.

Next, the caregiver leads the carereceiver 300 onto the seat surface 210 of the wheelchair 200 by using the slide board 34 and sliding the carereceiver 300 on the slide board 34, thereby completing the caregiving process in which the carereceiver 300 is moved from the position on the bed 100 onto the seat surface 210 of the wheelchair 200.

In the above-described sequence of operations, the legs of the carereceiver 300 do not interfere with the between-bed-and-wheelchair move assist apparatus and there is no need for the caregiver's operation to directly lift the carereceiver 300. Thus, the burden on the caregiver when the carereceiver 300 is moved from the bed 100 to the wheelchair 200 can be largely reduced.

For caregiving when the carereceiver 300 is moved from the wheelchair 200 to the bed 100, the sequence of operations reverse to that described above may be performed. Also in this case, there is no need for the caregiver's operation to directly lift the carereceiver 300. Thus, the burden on the caregiver when the carereceiver 300 is moved from the wheelchair 200 to the bed 100 can be largely reduced. In this case, the height of the surface of the mat 110 on the bed 100 is adjusted to a height generally equal to or slightly lower than the height of the seat surface 210 of the wheelchair 200.

Figure 16:
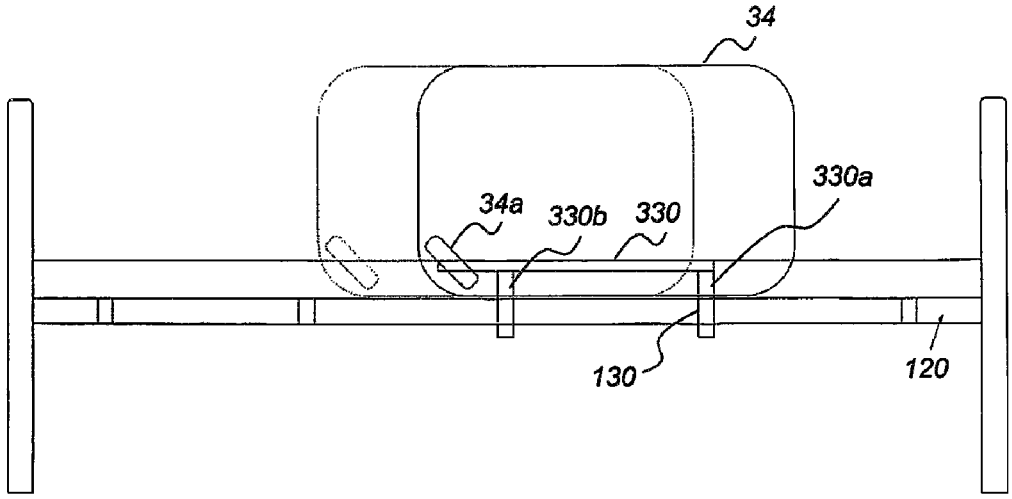
FIG. 16 is a diagram showing a mounted state of the between-bed-and-wheelchair move assist apparatus shown in FIG. 14 when the apparatus is not used.

FIG. 16 is a diagram showing a mounted state of the between-bed-and-wheelchair move assist apparatus shown in FIG. 14 when the apparatus is not used.

When the between-bed-and-wheelchair move assist apparatus shown in FIG. 14 is not used, it functions as a bed guard, as shown in FIG. 16, as does the between-bed-and-wheelchair move assist apparatus in the second embodiment. That is, in the between-bed-and-wheelchair move assist apparatus in the present embodiment, when the apparatus is not used, the slide board 34 is raised from the frame 120 of the bed 100 as shown in FIG. 16 to function as a bed guard.

(Fourth Embodiment)

Figure 17:
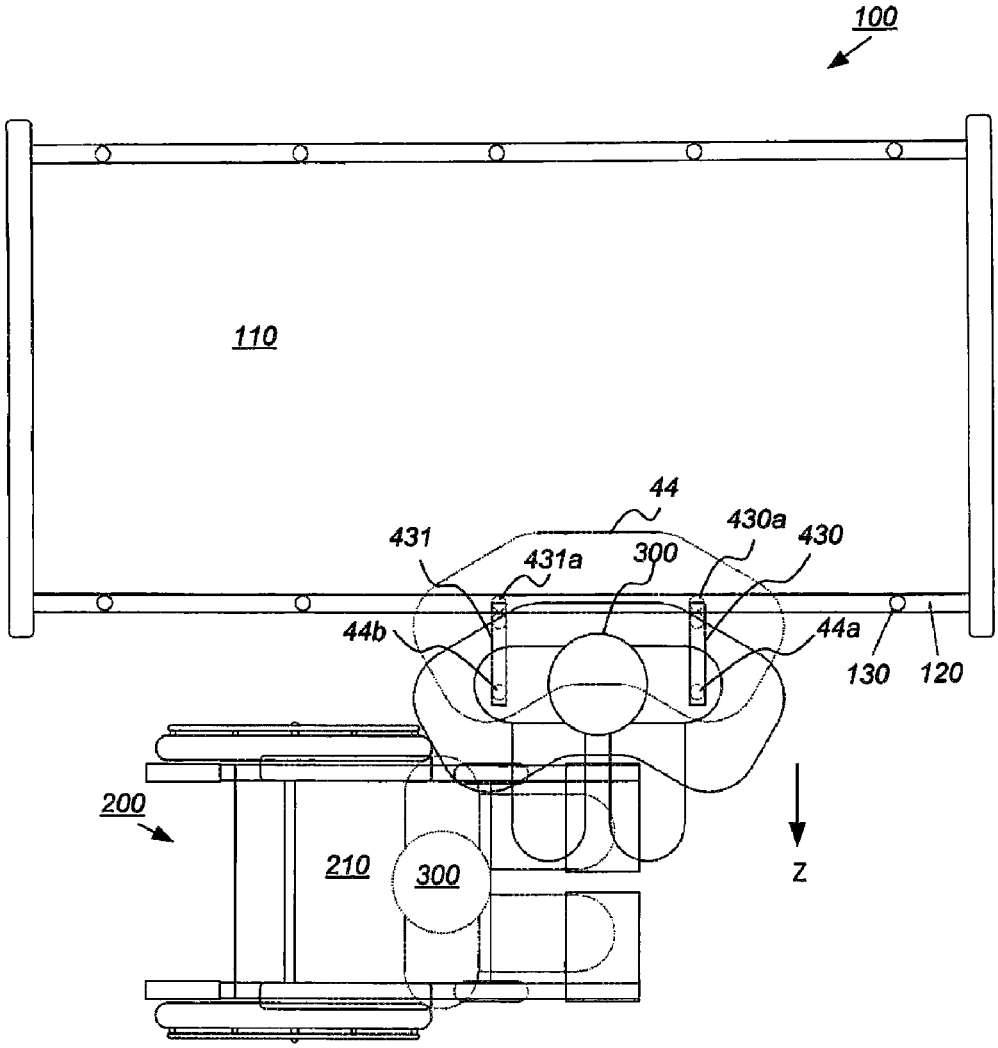
FIG. 17 is a diagram showing a between-bed-and-wheelchair move assist apparatus according to a fourth embodiment of the present invention.

FIG. 17 is a diagram showing a between-bed-and-wheelchair move assist apparatus according to a fourth embodiment of the present invention.

The between-bed-and-wheelchair move assist apparatus shown in FIG. 17 is mounted on the bed 100 by using the side rail mount holes 130 provided in the frame 120 of the bed 100, as are those in the first to third embodiments.

The between-bed-and-wheelchair move assist apparatus has two embedded portions 430*a* and 431*a* mounted by inserting one end of each embedded portion in the side rail mount hole 130 of the bed 100, two support portions 430 and 431 attached to the two embedded portions 430*a* and 431*a* so as to be turnable in a plane perpendicular to the bed 100, and a slide board 44 mounted on the two support portions 430 and 431 so as to be slidable in a direction perpendicular to the bed 100.

Projections 44*a* and 44*b* are provided on the lower surface of the slide board 44 in correspondence with the support portions 430 and 431. The slide board 44 is slid on the support portions 430 and 431 by using the projections 44*a* and 44*b*.

When the carereceiver 300 is moved from the bed 100 onto the wheelchair 200, the caregiver first adjusts the height of the surface of the mat 110 on the bed 100 to a height generally equal to or slightly higher than the height of the seat surface 210 of the wheelchair 200 by using a well-known height adjustor (not shown) provided on the bed, and sets the slide board 44 in a state indicated by a solid line in FIG. 17. The caregiver then moves the wheelchair 200 to a position indicated in FIG. 17 and locks the wheelchair 200 at this position from moving.

In this state, the caregiver leads the carereceiver 300 on the bed 100 to sit on the slide board 44 at the edge of the bed 100. This operation to lead the carereceiver 300 to sit on the slide board 44 can be performed without any considerable burden on the caregiver.

Figure 18:
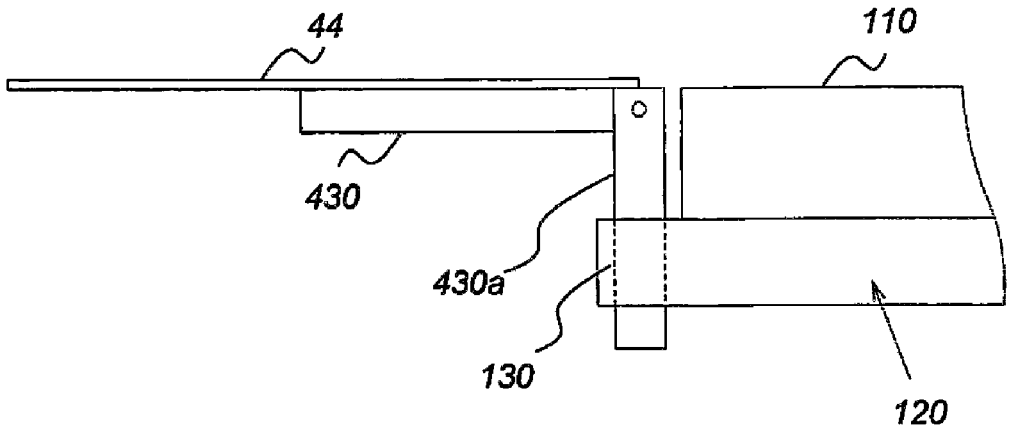
FIG. 18 is a diagram showing a mounted state of the between-bed-and-wheelchair move assist apparatus shown in FIG. 17 when the apparatus is used.

Next, the caregiver moves the slide board 44 on the two support portions 430 and 431 in a direction Z perpendicular to the bed 100 together with the carereceiver 300 to stretch the slide board 44 horizontally from the position above the mat 110 on the bed 100 so that one end of the slide board 44 is put on the seat surface 210 of the wheelchair 200. In this state, the upper surface of the mat 110 on the bed 100 and the seat surface 210 of the wheelchair 200 are bridged with the slide board 44. FIG. 18 is a side view showing a state where the end of the slide board 44 is stretched horizontally from the position above the mat 110 on the bed 100. The lower surface of the slide board 44 is supported by the two support portions 430 and 431.

Next, the caregiver leads the carereceiver 300 onto the seat surface 210 of the wheelchair 200 by using the slide board 44 and sliding the carereceiver 300 on the slide board 44, thereby completing the caregiving process in which the carereceiver 300 is moved from the position on the bed 100 onto the seat surface 210 of the wheelchair 200.

In the above-described sequence of operations, the legs of the carereceiver 300 do not interfere with the between-bed-and-wheelchair move assist apparatus and there is no need for the caregiver's operation to directly lift the carereceiver 300. Thus, the burden on the caregiver when the carereceiver 300 is moved from the bed 100 to the wheelchair 200 can be largely reduced.

For caregiving when the carereceiver 300 is moved from the wheelchair 200 to the bed 100, the sequence of operations reverse to that described above may be performed. Also in this case, there is no need for the caregiver's operation to directly lift the carereceiver 300. Thus, the burden on the caregiver when the carereceiver 300 is moved from the wheelchair 200 to the bed 100 can be largely reduced. In this case, the height of the surface of the mat 110 on the bed 100 is adjusted to a height generally equal to or slightly lower than the height of the seat surface 210 of the wheelchair 200.

Figure 19:
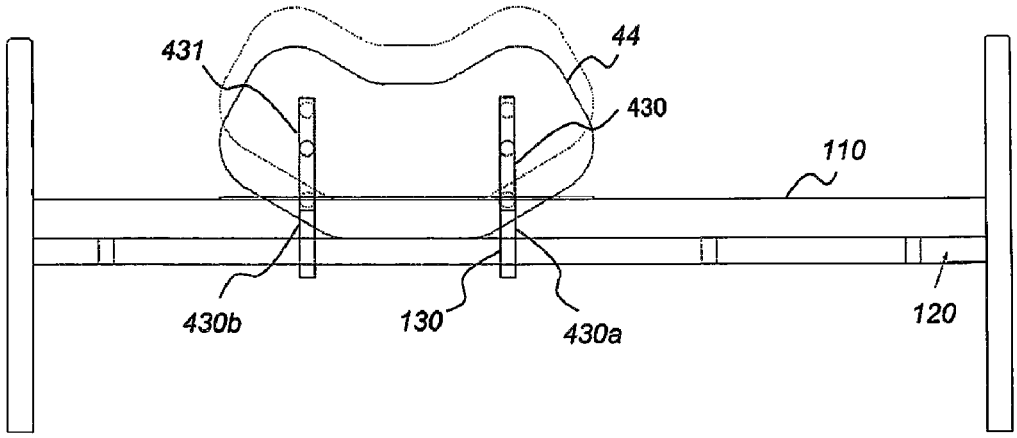
FIG. 19 is a diagram showing a mounted state of the between-bed-and-wheelchair move assist apparatus shown in FIG. 17 when the apparatus is not used.

FIG. 19 is a diagram showing a mounted state of the between-bed-and-wheelchair move assist apparatus shown in FIG. 17 when the apparatus is not used.

When the between-bed-and-wheelchair move assist apparatus shown in FIG. 17 is not used, it functions as a bed guard, as shown in FIG. 19, as does the between-bed-and-wheelchair move assist apparatus in the second or third embodiment. That is, in the between-bed-and-wheelchair move assist apparatus in the present embodiment, the support portions 430 and 431 are attached to the embedded portions 430*a* and 431*a* so as to be turnable in a plane perpendicular to the bed 100. When the between-bed-and-wheelchair move assist apparatus is not used, the slide board 44 is raised from the frame 120 of the bed 100 as shown in FIG. 19 to function as a bed guard.

Figure 20:
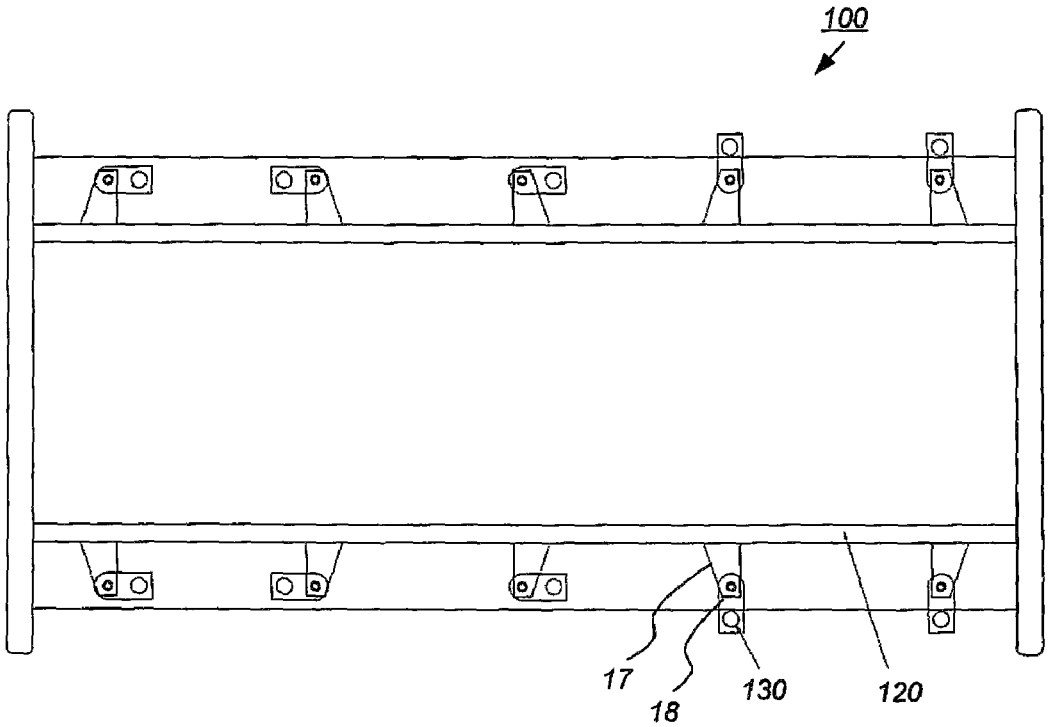
FIG. 20 is a diagram for explaining another example of the mount structure of the between-bed-and-wheelchair move assist apparatus according to the present invention.

FIG. 20 is a diagram showing another example of the mount structure for the between-bed-and-wheelchair move assist apparatus according to the present invention.

In the above-described first to fourth embodiments, the between-bed-and-wheelchair move assist apparatus is mounted on the bed 100 by using the side rail mount holes 130 provided in the frame 120 of the bed 100. However, some other beds have a structure in which side rail mount holes 130 are provided by using fittings 18 on projections 17 projecting from the frame 120 of the bed 100. In the case of mounting on a bed having such a structure, use of side rail mount holes 130 provided by using fittings 18 on projections 17 projecting from the frame 120 of the bed 100 enables the between-bed-and-wheelchair move assist apparatus according to the present invention to be mounted in the same way as in the above-described first to fourth embodiments.

While an example of typical embodiments of the present invention has been described, the present invention is not limited to the embodiments described above and shown in the drawings. The present invention can be implemented by being suitably modified within such a scope as not to change the gist of the invention.

What is claimed is:

1. A between-bed-and-wheelchair move assist apparatus arranged to facilitate a caregiver to help a carereceiver to move between a bed and a wheelchair, said between-bed-and-wheelchair move assist apparatus comprising:

a U-shaped support member formed of two support portions disposed parallel to each other and a common support portion to which one end of each of the two support portions is connected;

a first mount shaft embedded in a first axial support portion axially supporting the common support portion, the first mount shaft having its tip end inserted in the side rail mount hole of the bed;

a second mount shaft connected to the first mount shaft through an arm portion, the second mount shaft having its tip end inserted in another side rail mount hole of the bed;

a slide board mounted so as to be turnable about one of the two support portions used as a shaft for turning;

and lock means provided on the first mount shaft, the lock means locking the slide board from turning when a predetermined angle of turning of the slide board is reached, wherein the lock means has:

a cut portion provided in a second axial support portion axially supporting the first mount shaft at one end of the arm portion, the cut portion being formed at a position corresponding to the predetermined angle of the first mount shaft; and a lock plate attached to the first mount shaft, the lock plate being fitted in the cut portion when the predetermined angle of turning of the first mount shaft is reached.

* * * * *